US012583557B2

(12) United States Patent
Tierney

(10) Patent No.: US 12,583,557 B2
(45) Date of Patent: Mar. 24, 2026

(54) FUEL DELIVERY SYSTEM

(71) Applicant: Dennis J. Tierney, Narragansett, RI (US)

(72) Inventor: Dennis J. Tierney, Narragansett, RI (US)

(73) Assignee: The United States of America as represented by the Secretary of the Navy

( * ) Notice: Subject to any disclaimer, the term of this patent is extended or adjusted under 35 U.S.C. 154(b) by 319 days.

(21) Appl. No.: 18/213,362

(22) Filed: Jun. 23, 2023

(65) Prior Publication Data

US 2024/0425146 A1 Dec. 26, 2024

(51) Int. Cl.

| | |
|---|---|
| ***B63B 17/00*** | (2006.01) |
| ***B63B 79/30*** | (2020.01) |
| ***B63G 8/08*** | (2006.01) |
| ***F42B 35/00*** | (2006.01) |

(52) U.S. Cl.

CPC ..... *B63B 17/0027* (2013.01); *B63B 79/30* (2020.01); *B63G 8/08* (2013.01); *F42B 35/00* (2013.01)

(58) Field of Classification Search

CPC ..... F02C 7/22
USPC ..... 73/117.1
See application file for complete search history.

(56) References Cited

U.S. PATENT DOCUMENTS 5,780,729 A * 7/1998 Escobar ..... F02C 7/22 137/557

* cited by examiner

*Primary Examiner* — Nathaniel T Woodward
(74) *Attorney, Agent, or Firm* — James M. Kasischke; Jeffry C. Severson

(57) ABSTRACT

Systems are provided for an engine fuel delivery system for vehicles under test. In one example, a fuel delivery system includes a bulk fuel storage tank to house bulk fuel at low pressure and an on-board fuel tank to house smaller quantities of pressurized fuel to be fed to a vehicle propulsion system. The fuel delivery system further includes a positive displacement pump to pressurize fuel from the bulk fuel storage tank and feed fuel to the on-board fuel tank. A plurality of valves and sensors are further included with an arrangement of fuel lines to monitor and direct fuel flowing in the fuel delivery system.

18 Claims, 1 Drawing Sheet

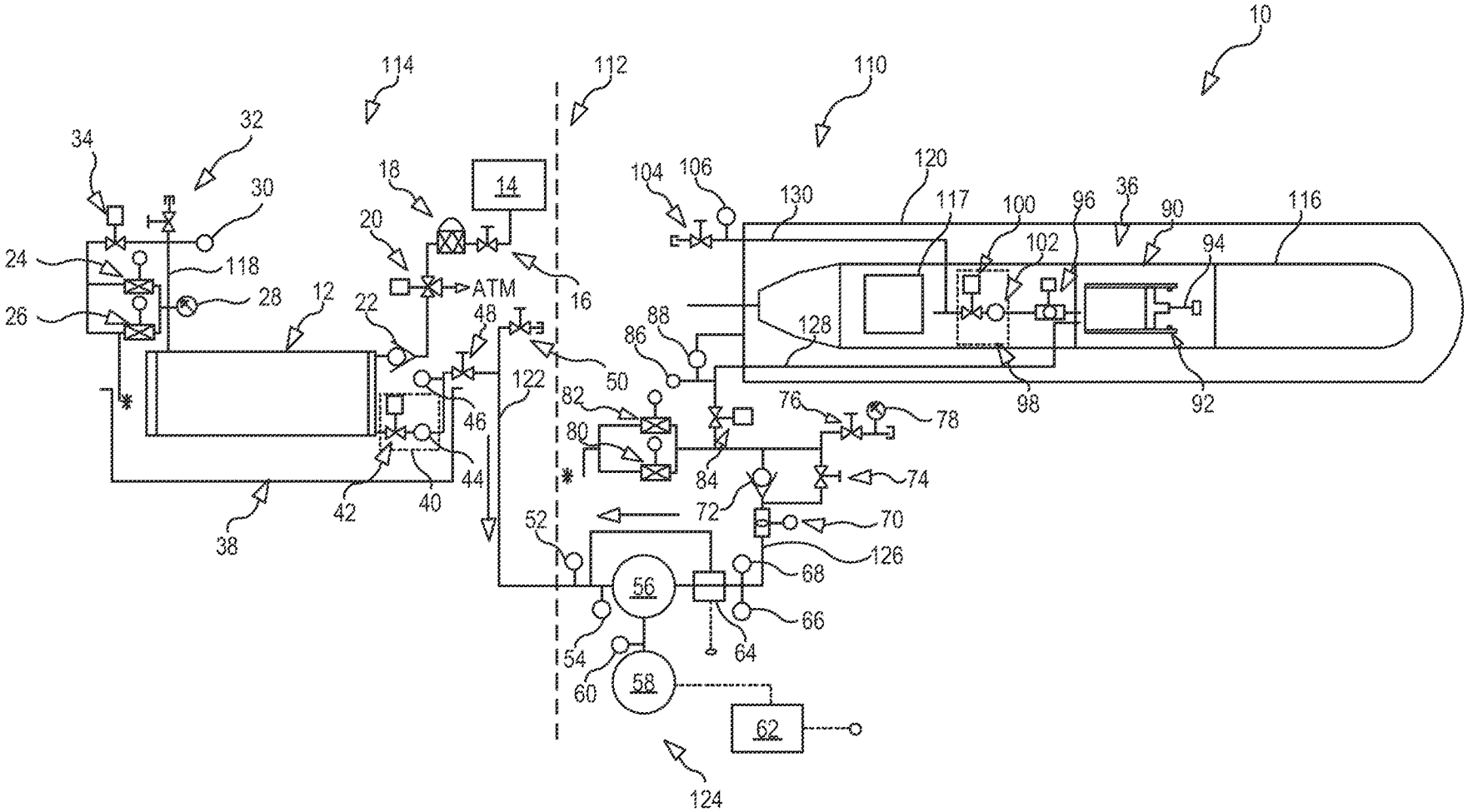
10
110
112
114
124
ATM
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
116
117
118
120
122
126
128
130

FUEL DELIVERY SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The invention relates to a fuel delivery system for a vehicle under test. The invention allows for a bulk fuel to be stored at relatively low pressure outside a test cell and a minimal amount of fuel to be stored at higher pressure on-board the vehicle under test within the test cell.

(2) Description of the Prior Art

Torpedoes are routinely subjected to land based testing to evaluate the on board propulsion system. In such land based testing, one system involves situating and immobilizing a torpedo in a test cell. To simulate load on the drive shaft of the propulsion system of the torpedo, the propeller drive shaft is mechanically connected to a torque device, e.g., a dynamometer. The test cell is an air-tight and water-tight structure. The test cell is flooded with water such that an immobilized torpedo therein is completely submerged in water during the test. The water in the test cell is controllably pressurized to duplicate (e.g., simulate) a depth condition of interest. The torpedo's propulsion system is then tested by running its onboard motor. The engine can be run at different speeds and under different tank pressures to comprehensively assess the performance capabilities of the torpedo's propulsion system under a wide variety of simulated operating conditions.

A heavyweight torpedo, such as those tested in this manner, has an external combustion engine powered by Otto fuel. The Otto fuel used to power the engine is a non-corrosive liquid fuel monopropellant developed specifically for use in underwater propulsion systems. "Otto fuel", for purposes of this application, encompasses "Otto Fuel II", which is a known, combustible torpedo fuel based on propylene glycol dinitrate as a propellant. Otto Fuel II also typically contains smaller amounts of adjuvants such as a stabilizer or desensitizer (e.g., 2-nitrodiphenylamine), and a plasticizer (e.g., di-n-butyl sebacate). Pressurized Otto fuel, in general, is less stable and more susceptible to inadvertent reactions. In particular, Otto Fuel II can react or deflagrate if it is confined and subjected to pressures in excess of 50 PSIG or temperatures in excess of 250 degrees fahrenheit.

In order to run the propulsion system on board to test a torpedo for an extended period of time without interruption of the test sequence, a relatively large quantity of Otto fuel is made available to the test torpedo. In prior land based testing of heavyweight torpedoes, for instance, in excess of 100 gallons of pressurized Otto fuel has been stored on board the test torpedo. If this quantity of pressurized, combustible Otto fuel inadvertently reacts within the test cell, the uncontrolled fuel reaction emanating from the fuel stored aboard the test torpedo can cause serious structural damage. Even if a test cell largely contains and absorbs the blast to protect the surrounding area, the reaction can result in the loss of test facility assets.

Systems are available for transporting and handling fluids under high pressure as well as systems for delivering a high melting point oil in a tank. None of these available arts address and solve the problems raised by exposure of relatively large quantities of combustible fuel to pressure.

SUMMARY OF INVENTION

It is therefore the object of the present disclosure to provide a fuel delivery system for a test cell which reduces the possibility of uncontrolled fuel reaction during testing of vehicles, such as torpedoes.

As one example, a fuel delivery system is provided that separates a bulk fuel tank at low pressure from an on-board fuel under pressure tank, thereby limiting the quantity of fuel under pressure at any given time, such as during a test sequence for a vehicle engine. The fuel delivery system thus effectively reduces the magnitude of a reaction, and thus the scale of any damage associated with any inadvertent reaction of pressurized fuel. Additionally, sensors, relief valves, and other components included in the fuel delivery system further reduce possibility of over-heating and/or decomposition of the fuel.

The fuel delivery system of this disclosure includes a bulk fuel storage tank that is mechanically isolated from and located outside the test cell, such as where the propulsion system of an underwater vehicle is actually tested, in a fuel support cell. The fuel delivery system includes means which controllably limit the quantity of fuel from the bulk fuel storage tank that is pressurized and delivered to an on-board fuel tank within the test cell. The quantity of fuel is thus limited to the quantity necessary to support the combustion requirements of an engine being tested. The test cell houses both the test vessel in which the vehicle is actually tested, and a fuel delivery system used to pressurize, store, and feed controlled and reduced quantities of pressurized fuel from the bulk fuel storage tank to the test vehicle. The fuel delivery system thus effectively reduces the magnitude of a reaction, and thus the scale of any damage associated with any inadvertent reaction of pressurized fuel.

The fuel delivery system is located partially outside the vehicle and partially inside the vehicle, and is located inside the test cell. More particularly, the fuel delivery system includes a pumping system, an on-board fuel tank, a plurality of sensors and valves, and an arrangement of fuel lines adequate to permit fluid communication between these components. Fuel is drawn from the bulk fuel storage tank located outside the test cell and fed into the test cell for handling (processing) by the fuel delivery system. Before being fed for combustion by the engine aboard the test vehicle, fuel is first pressurized through a pumping system. The on-board fuel tank includes an accumulator to adjust fuel delivered to the engine based on engine speed demands during acceleration.

In one embodiment, the fuel delivery system includes a positive displacement pump used to pressurize fuel. A plurality of valves and sensors included proximate to the positive displacement pump control and monitor pressure, temperature, and speed of the pressurized fluid. The pressure of the fuel may be set to mimic at depth conditions. The fuel delivery system uses feedback control in order for the positive displacement pump (and associated motor) to match vehicle engine pump performance conditions. Primary feedback control uses a correlation of external pump speed with piston displacement (of the accumulator described above). Secondary feedback control matches pump speeds and repositions an external speed control valve with piston displacement. The fuel delivery system further utilizes nominal piston positions to set acceleration rates due to transient engine performance.

In this way, the fuel delivery system of the present disclosure, including mechanical separation of the bulk fuel storage tank from the test cell, allows for modification of the fuel tank provided aboard the vehicle, e.g., a torpedo, such that it stores small quantities of fuel directly aboard the vehicle within the test cell. Namely, a minimal amount of fuel demanded to power the engine and tolerate instantaneous fuel flow fluctuations in the fuel lines is to be stored directly aboard the vehicle in the test cell. Overall, the fuel delivery system allows for matched simulated fuel speeds and depth under all conditions in order to provide built-in resiliency and reduce force of reactions resultant from overpressure of the fuel.

Further, the fuel delivery system is supplemented with reaction suppression fitting means (e.g., detonation traps) at outlets of each of the bulk fuel storage tank and on-board fuel tank. The detonation traps help confine any pressurized fuel reaction within the fuel support cell in which the bulk fuel storage tank is housed and/or the test cell in which the vehicle and on-board fuel tank is housed, thereby preventing propagation of a fuel reaction through fuel lines. For example, this arrangement prevents any reaction of the pressurized fuel from propagating into the fuel support cell from the test cell, or vice versa, or from propagating from a fuel line back into one of the fuel tanks. In this way, damage associated with any reaction may be mitigated.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Features of illustrative embodiments may be understood from the accompanying drawings in conjunction with the description. The elements in the drawings may not be drawn to scale. Some elements and/or dimensions may be enlarged or minimized for the purpose of illustration and understanding of the disclosed embodiments.

The FIGURE is a diagram showing a fuel delivery system.

DETAILED DESCRIPTION

The following description relates to systems and methods for a fuel delivery system 10 for a vehicle, for example an underwater propulsion vehicle such as a torpedo. The FIGURE illustrates a diagram of the fuel delivery system 10, including components comprised therein.

Referring now to the FIGURE, an embodiment of the fuel delivery system 10 is shown. A bulk fuel storage tank 12 is situated physically outside of a test cell 110. Dashed line 112 denotes a mechanical and/or physical separation between a fuel support cell 114 and the test cell 110. For example, dashed line 112 may represent a wall (e.g., a firewall) constructed of a material resistant to reactions. The bulk fuel storage tank 12 storing a bulk fuel is provided with a predetermined pressure (e.g., at most 50 PSIG) that it does not exceed, therefore keeping the bulk fuel at low pressure (e.g., less than or equal to the predetermined pressure such as 50 PSIG) and reducing possibility of reactions of the fuel. The fuel support cell 114 is a solid enclosure containing a portion of the fuel delivery system 10, including the bulk fuel storage tank 12, fuel lines, and more, as will be described. The test cell 110 houses other portions of the fuel delivery system 10 as well as a test vehicle 116 when the test vehicle 116 is undergoing testing of its on-board propulsion system 117 (e.g., vehicle under test drive system). The test vehicle 116 illustrated in the FIGURE is an underwater vehicle (e.g., a torpedo), though the illustration is provided merely for the sake of illustration and not limitation.

A pressure-over-liquid arrangement is employed for bulk fuel storage tank 12 where the fuel is covered by an air layer with an intervening water layer precluding air entrapment in the fuel. In one example, the air layer comprises $CO_2$ gas. In particular, a $CO_2$ supply 14 is in fluid communication with the bulk fuel storage tank 12. During a test run, $CO_2$ from the $CO_2$ supply 14 passes through a first manual valve 16 when the first manual valve 16 is open. $CO_2$ then passes through a regulator 18, the regulator 18 acting to fix a pressure of the $CO_2$. After passing through the regulator 18, the $CO_2$ passes through a first solenoid valve 20. In some examples, the first solenoid valve 20 is a normally vented solenoid valve. When the first solenoid valve 20 is in a closed position, $CO_2$ gas in the line may be discharged to the atmosphere or a $CO_2$ capture device. A check valve 22 is further included in the $CO_2$ line to prevent backflow of $CO_2$ from the bulk fuel storage tank 12 towards the $CO_2$ supply 14.

A plurality of relief valves are further included in the fuel support cell 114, including at least one bulk fuel storage relief valve, e.g., a first relief valve 24 and a second relief valve 26. A first pressure gauge 28 monitors pressure within a fuel line 118 feeding the plurality of relief valves. If pressure is above a preset pressure threshold, fuel is discharged via one or both of first relief valve 24 and/or second relief valve 26 into a prescribed containment. Further valves and sensors are included on the fuel line 118, including a first pressure sensor 30, a second manual valve 32, and a second solenoid valve 34. The second solenoid valve 34 is normally open and allows flow to the first and second relief valves 24, 26 if the first pressure gauge 28 reads pressure above the preset pressure threshold. The first pressure sensor 30, and other pressures sensors described herein are capable of sensing (e.g., detecting) output fuel pressure of a tank or pump, e.g., bulk fuel storage tank 12. As such, pressure sensors increase monitoring of the fuel within the system, thereby reducing possibility of uncontrolled reactions resultant from overly pressurized fuel.

The test cell 110 has a common wall with the fuel support cell 114, represented by dashed line 112 as described. A pressure vessel 120 may be housed within the test cell 110, the test vehicle 116 being situated within the pressure vessel 120 during testing. Pressure vessel 120 is air-tight and water-tight. The test cell 110 is a hardened structure open to explosive blast arc in one direction for pressure relief. In land based testing, conventional methods are used to situate and immobilize the test vehicle 116 within the pressure vessel 120. To simulate load on the drive shaft of the propulsion system of the test vehicle 116, the propeller drive shaft is mechanically connected to a torque device of a conventional kind (e.g., a dynamometer (not shown)). During a test run, the pressure vessel 120 is completely flooded and filled with water such that the immobilized test vehicle 116 therein is completely submerged in water during the test. The water in the test cell 110 is controllably pressurized by a depth control of conventional design and usage to duplicate the pressure at the depth condition of interest. The test vehicle's propulsion system is then tested by running its on-board motor.

The components of the propulsion system for the test vehicle 116, other than its on-board fuel tank (e.g., an on-board fuel tank 36) include components common to conventional propeller systems, for example for a torpedo, which will be appreciated by those of ordinary skill in the art and which do not form essential parts of the present disclosure. For example, suitable conventional torpedo propulsion systems include a propeller mounted at the stern end of an internally mounted propeller drive shaft. The propeller is driven rotationally by the drive shaft. The drive shaft is driven by a combustion engine powered by Otto fuel stored aboard the torpedo.

During a test run, the torpedo's propulsion system 117 is tested under varying conditions of pressure and speed as conducted in test cell 110. The fuel needed to power the torpedo's propulsion system directly draws upon a small reservoir of fuel stored in an on-board fuel tank 36 aboard the test vehicle 116 itself. By modifying the on-board fuel tank 36 to store the minimal amount of fuel demanded to power the engine and tolerate instantaneous fuel flow fluctuations in the fuel lines at variable pressures, the reaction force of any inadvertent reaction associated with the fuel stored aboard the test vehicle 116 is significantly reduced. In order to replenish the fuel in the on-board fuel tank 36, as it is consumed to power the engine of the test vehicle 116, the fuel delivery system 10 is employed. The predetermined pressure of the bulk fuel storage tank 12 (e.g., below 50 PSIG) is lower than the variable pressures employed by the on-board fuel tank 36.

The fuel delivery system 10 is supplied fuel from the bulk fuel storage tank 12 located outside the test cell 110. The bulk fuel storage tank 12 resides within a fuel tank container 38. A fuel shut-off solenoid valve 40 also resides within the fuel tank container 38 and is in fluid communication with the bulk fuel storage tank 12 via a fuel line 122. The fuel shut-off solenoid valve 40 comprises a third solenoid valve 42 and a first detonation trap 44. The third solenoid valve 42 is normally closed, and actuated (e.g., energized) to open allowing fuel to flow from the bulk fuel storage tank 12 towards the test cell 110 via the fuel line 122. Further, a blanket of water (not shown) floats on top of the fuel in the bulk fuel storage tank 12 to negate the possibility of air entrapment in the fuel as fuel is fed to the test cell 110 and consumed by the engine of the test vehicle 116.

The first detonation trap 44, and other detonation traps described below, are provided in fuel lines in order to confine any reaction of pressurized fluid to within the fuel support cell 114 (or the test cell 110 for detonation traps located within the test cell 110) by preventing propagation of fuel blasts through fuel lines into adjacent cells that are otherwise in fluid communication with the cell in which the blast occurs. For example, first detonation trap 44 prevents any reaction of the pressurized fuel from propagating into the test cell 110 from the fuel support cell 114. Detonation trap 44 may be a valve that allows a pressure differential in one direction while closing to a pressure differential in the opposite direction. In this way, degradation to the test cell 110, the test vehicle 116, and/or the fuel support cell 114 is reduced.

Fuel that has been drawn from the bulk fuel storage tank 12 into the fuel line 122, the fuel line 122 being adequate to perform fluid communication to-and-from and between components included therein or thereon. Fuel line 122 move fuel towards the test cell 110, passing a first temperature sensor 46 and a third manual valve 48 after exiting the fuel shut-off solenoid valve 40. The first temperature sensor 46, and other temperature sensors described herein are capable of sensing output fuel temperature from tanks or pumps, e.g., bulk fuel storage tank 12. In this way, temperature sensors included in the fuel delivery system 10 increase monitoring of temperature of the fuel and therefore reduce reactions resultant from excessive temperatures of the fuel.

A fourth manual valve 50 is further included to allow for drainage of fuel from fuel line 122. Once in the test cell 110, fuel is first fed through a pumping system 124. After passing a set of pressure and temperature sensors, e.g., a second pressure sensor 52 and a second temperature sensor 54, fuel is fed into an input of a positive displacement pump 56. The input of the positive displacement pump 56 is in fluid communication with the bulk fuel storage tank 12 via fuel line 122.

Positive displacement pump 56 is configured to pressurize and pump fuel towards the on-board fuel tank 36. The positive displacement pump 56 is driven by motor 58. A speed pickup sensor 60 senses the speed of the motor 58. AC (Alternating Current) drive 62 controls the speed of the motor 58. A speed control valve 64 is included on a line of an arrangement of fuel lines 126 to adjust output flowrate from the positive displacement pump 56 and the fuel pressurization. The fuel pumped by the positive displacement pump 56 is pumped against a depth control system reference pressure. Simulated depth pressure is measured at pressure vessel 120. Pressure sensors downstream of positive displacement pump 56 are used as feedback to achieve desired simulated depth pressure.

After exiting an output of the positive displacement pump 56, fuel is directed towards the on-board fuel tank 36, passing through a plurality of valves, sensors and the like, including at least one positive displacement pump relief valve and at least one differential pressure sensor, included in the arrangement of fuel lines 126. The output of the positive displacement pump 56 is in fluid communication with the on-board fuel tank 36. Another set of temperature and pressure sensors, e.g., a third pressure sensor 66 and a third temperature sensor 68, monitors pressure and temperature of the fuel output from the pumping system 124. A flow meter 70 permits feed rate to be monitored to provide feedback control for setting of the speed control valve 64. A check valve 72 prevents fuel from back flowing towards the pumping system 124. A fifth manual valve 74 and a sixth manual valve 76 are included to allow discharge of fuel if needed. A second pressure gauge 78 detects pressure of the fuel as it discharges from the fuel delivery system 10.

Another plurality of relief valves, including third and fourth relief valves 80 and 82, allow the fuel lines 126 to be bled off when the third pressure sensor 66 indicates that pressure at the output of the positive displacement pump 56 exceeds a preset pressure. If fuel is bled off in this manner, the fuel is discharged into a prescribed containment center, this may be the same prescribed containment center that the first and second relief valves 24, 26 discharge fuel into or in alternative embodiments, different prescribed containments may be used. Vented fuel may, in some examples, be separated by the firewall denoted by dashed line 112. In other examples, however, vented fuel in test cell 110 may not be separated when at atmospheric pressure.

During a test run, fuel in fuel lines 126 is then fed through fourth solenoid valve 84 (normally closed) when the fourth solenoid valve 84 is energized and opened. Fuel is monitored by fourth pressure sensor 86 as it is fed into the pressure vessel 120. A differential pressure sensor 88 is further in fluid communication with the pressure vessel 120, signals from the differential pressure sensor 88 providing signals to adjust settings of the speed control valve 64 and bypass flow correction.

Fuel line 128 inside the pressure vessel 120 feeds fuel from fuel lines 126 to the on-board fuel tank 36. Fuel in fuel line 128 is directed into the on-board fuel tank 36 and into a fuel accumulator 90, the fuel accumulator 90 feeding fuel towards the propulsion system 117 based upon a primary feedback control system whereby the amount of fuel pushed towards the propulsion system 117 correlates with the speed of the engine. The fuel accumulator 90 comprises a piston 92 and a spring 94 which act to push fuel out of the fuel accumulator 90 based on the primary feedback control.

During the test run, fuel stored in the on-board fuel tank 36 is fed from the fuel accumulator 90 to the propulsion system 117 through a second flow meter 96 and a unit under test fuel shut-off solenoid valve 98. The unit under test fuel shut-off solenoid valve 98 comprises a fifth solenoid valve 100 (normally closed) that is energized and opened during the test run and a second detonation trap 102, which acts as described previously. A fuel line 130 is further included in the pressure vessel 120. Fuel in the fuel line 130 is discharged from the system through a seventh manual valve 104, passing a fifth pressure sensor 106.

As described, the fuel delivery system 10 is monitored and controlled remotely through the plurality of valves (e.g., solenoid valves), pressure and temperature sensors, and others as discussed herein. In some examples, a computer controller (not shown) is provided in communication with components herein to actuate valves, detect pressures and temperatures as sensed by the sensors, and to shut down systems, such as the pumping system 124, in the event of pressure overload or other unsuitable condition.

By virtue of the fuel delivery system 10 provided herein, including the bulk fuel storage tank 12 positioned in the fuel support cell 114 outside the test cell 110, modification to the on-board fuel tank 36 can be made such that pressurized fuel within the test cell 110 is minimized. Minimizing the amount of pressurized fuel within the test cell 110 reduces potential over-heating or decomposition of the fuel that may result in an uncontrolled reaction.

The fuel delivery system 10 herein described is configurable to support fuel flow for a desired platform. For example, when the test vehicle 116 is a heavyweight torpedo, the pressure thresholds and other configurable conditions of the system may be such as to reduce degradation of a monopropellant fuel like Otto fuel while maintaining propulsion demands of the heavyweight torpedo.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fuel delivery system, comprising:

a test cell for housing a vehicle under test drive system;

a fuel support cell separated from said test cell;

a bulk fuel storage tank for storing fuel at a pressure of at most 50 PSIG, said bulk fuel storage tank located in said fuel support cell wherein said bulk fuel storage tank is capable of storing fuel under a layer of water, and the layer of water being covered by a layer of gas, wherein the layer of water precludes air entrapment in the fuel;

a $CO_2$ supply joined in communication with said bulk fuel storage tank, $CO_2$ acting as the layer of gas;

an on-board fuel tank located within said test cell, said on-board fuel tank storing fuel at a pressure greater than 50 PSIG for communication with the housed vehicle under test drive system;

a positive displacement pump located inside said test cell, said positive displacement pump including an input in fluid communication with said bulk fuel storage tank and an output in fluid communication with said on-board fuel tank; and a plurality of valves and sensors positioned in fluid communication between said bulk fuel storage tank and said positive displacement pump and between said positive displacement pump and said on-board fuel tank.

2. The fuel delivery system of claim 1 further comprising:

a first detonation trap positioned in fluid communication between said bulk fuel storage tank and said positive displacement pump; and a second detonation trap positioned between said on-board fuel tank and the vehicle under test drive system, said first and second detonation traps provided to prevent propagation of fuel reactions through said fuel delivery system.

3. The fuel delivery system of claim 1 wherein said plurality of valves and sensors comprises:

a first pressure sensor positioned between said bulk fuel storage tank and said positive displacement pump to sense output fuel pressure from said bulk fuel storage tank;

a second pressure sensor positioned between said positive displacement pump and said on-board fuel tank to sense output fuel pressure from said positive displacement pump; and a third pressure sensor positioned between said on-board fuel tank and said vehicle under test drive system to sense output fuel pressure from said on-board fuel tank.

4. The fuel delivery system of claim 1, wherein said plurality of valves and sensors comprises at least one relief valve positioned in fluid communication with said bulk fuel storage tank, said at least one bulk fuel storage relief valve discharging fuel from said bulk fuel storage tank when a first sensor of said plurality of valves and sensors indicates that pressure in said bulk fuel storage tank exceeds a preset pressure.

5. The fuel delivery system of claim 4, wherein said plurality of valves and sensors comprises at least one positive displacement pump relief valve positioned in fluid communication with the output of said positive displacement pump, said at least one positive displacement pump relief valve discharging fuel when a second sensor of said plurality of valves and sensors indicates that pressure at the output of said positive displacement pump exceeds a second preset pressure.

6. The fuel delivery system of claim 1, further comprising a speed control valve in fluid communication with said positive displacement pump, said speed control valve controlling a flowrate of fuel provided to and outputted from said positive displacement pump.

7. The fuel delivery system of claim 6, wherein the vehicle under test drive system is housed aboard a pressure vessel located inside said test cell.

8. The fuel delivery system of claim 7, wherein said plurality of valves and sensors comprises at least one differential pressure sensor, said differential pressure sensor positioned in fluid communication between said pressure vessel and said speed control valve.

9. The fuel delivery system of claim 8, wherein said differential pressure sensor provides a signal that is used to adjust settings of said speed control valve.

10. The fuel delivery system of claim 1, further comprising a motor joined to said positive displacement pump to drive said positive displacement pump.

11. The fuel delivery system of claim 1 further comprising a regulator joined between said $CO_2$ supply and said bulk fuel storage tank for controlling gas pressure in the layer of gas.

12. The fuel delivery system of claim 11 further comprising at least one of a manual valve, a normally vented solenoid valve, a check valve, or any combination thereof, in communication between said regulator and said bulk fuel storage tank.

13. The fuel delivery system of claim 1, wherein the fuel stored in said bulk fuel storage tank is stored at a pressure below 50 PSIG.

14. The fuel delivery system of claim 1, wherein the fuel stored in said on-board fuel tank is pressurized by said positive displacement pump.

15. The fuel delivery system of claim 1, further comprising a fuel accumulator positioned within said on-board fuel tank, said fuel accumulator adjusting output flowrate of the fuel.

16. The fuel delivery system of claim 1, wherein said on-board fuel tank stores fuel at variable pressures and said bulk fuel storage tank stores fuel at a predetermined pressure.

17. The fuel delivery system of claim 16, wherein the predetermined pressure of the fuel within said bulk fuel storage tank is lower than the variable pressures of the fuel within said on-board fuel tank.

18. The fuel delivery system of claim 1, wherein the fuel is a monopropellant fuel.

* * * * *